US008369730B2

(12) United States Patent
Fujimoto

(10) Patent No.: US 8,369,730 B2
(45) Date of Patent: Feb. 5, 2013

(54) FIXING DEVICE

(75) Inventor: Yoshihisa Fujimoto, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 159 days.

(21) Appl. No.: 12/037,772

(22) Filed: Feb. 26, 2008

(65) Prior Publication Data

US 2008/0205924 A1 Aug. 28, 2008

(30) Foreign Application Priority Data

Feb. 28, 2007 (JP) ..... 2007-049277

(51) Int. Cl.
*G03G 15/20* (2006.01)

(52) U.S. Cl. ..... 399/67; 399/122; 399/329

(58) Field of Classification Search ..... 399/67, 399/70, 38, 68, 75, 122, 320, 322, 328–332, 399/335, 337, 361, 400; 219/216, 244
See application file for complete search history.

(56) References Cited

U.S. PATENT DOCUMENTS

| | | | | |
|---|---|---|---|---|
| 5,915,146 | A * | 6/1999 | Kusaka et al. | 399/68 |
| 2004/0151515 | A1* | 8/2004 | Nakayama | 399/67 |
| 2005/0207770 | A1* | 9/2005 | Nihonyanagi et al. | 399/67 |
| 2006/0127144 | A1* | 6/2006 | Watanabe | 399/329 |
| 2006/0216077 | A1* | 9/2006 | Komuro | 399/328 |
| 2006/0257180 | A1* | 11/2006 | Nakagawa et al. | 399/329 |
| 2008/0175613 | A1* | 7/2008 | Fukai et al. | 399/67 |

FOREIGN PATENT DOCUMENTS

| | | |
|---|---|---|
| JP | 3-100582 | 4/1991 |
| JP | 2004-184476 A | 7/2004 |
| JP | 2005-148618 A | 6/2005 |
| JP | 2005-250282 A | 9/2005 |

OTHER PUBLICATIONS

Japanese Office Action, mailed Jan. 20, 2009, directed to counterpart Japanese Patent Application No. 2007-049277; 8 pages.

* cited by examiner

*Primary Examiner* — Walter L Lindsay, Jr.
*Assistant Examiner* — Benjamin Schmitt
(74) *Attorney, Agent, or Firm* — Morrison & Foerster LLP

(57) ABSTRACT

A fixing device has a heating rotor, a pressure belt, a sheet member, first and second pressurizing members, a motor and a control unit. The control unit controls the motor to rotate the heating rotor and the pressure belt in a direction opposite to a conveyance direction of a recording material at startup time after jam treatment of the recording material. Contact positions of the sheet member with respect to the first and second pressurizing members are changed, so that the sheet member is prevented from obstructing independent actions of each of the first and second pressurizing members, which allows the nip portion N to maintain proper nip width and proper nip pressure. Thus, the fixing device has excellent stability at the nip portion to improve fixability and conveyability of the recording material with a simple construction.

8 Claims, 12 Drawing Sheets

FIXING DEVICE

CROSS-REFERENCE TO RELATED APPLICATION

This application is based on application No. 2007-049277 filed in Japan, the entire content of which is hereby incorporated by reference.

BACKGROUND OF THE INVENTION

The present invention relates to a fixing device for use in an image forming apparatus such as a copying machine, a printer or a facsimile.

Conventionally, there has been a fixing device including a pivotable fixing roller, an endless belt, a first pressure pad, a second pressure pad, and a low friction sheet, wherein the endless belt moves while forming a nip portion in pressure contact with the fixing roller, wherein the first and second pressure pads are placed inside the endless belt and bring the endless belt in pressure contact with the fixing roller at the nip portion, and wherein the low friction sheet is provided between the endless belt and the first and second pressure pads (JP 2005-148618A).

However, the first and second pressure pads have a construction in which the first and second pressure pads utilize the identical low friction sheet in the conventional fixing device. Therefore, the independent actions of the first and second pressure pads are obstructed by the low friction sheet. As the result, there has been such a problem as to fail in maintaining the nip portion to proper nip width and nip pressure. Thus, there have been problems in fixability and conveyability of a recording material at the nip portion since the nip portion has an inferior stability as stated above.

It is often the case where the nip portion cannot be maintained in the proper state particularly after removing the recording material jammed between the fixing roller and the endless belt (after jam treatment of the recording material) or after changing a pressure contact force between the fixing roller and the endless belt (after fixing mode change). This has been a problem to be necessarily solved in developing a fixing device that requires the diversity of the recording material and the reliability of the print quality.

BRIEF SUMMARY OF THE INVENTION

An object of the present invention is to provide a fixing device which has excellent stability at the nip portion and improve the fixability and conveyability of the recording material with a simple construction.

In order to achieve the above-mentioned object, one aspect of the present invention provides a fixing device comprising:

a heating rotation unit heated by a heat source and rotated by a driving source;

an endless pressure belt brought in external contact with the heating rotation unit and rotated to follow rotation of the heating rotation unit;

a plurality of pressurizing members arranged side by side inside the pressure belt in a rotation direction of the pressure belt and pressurizing the pressure belt against the heating rotation unit;

a sheet member placed between the pressure belt and the plurality of pressurizing members and slid on an inner surface of the rotating pressure belt; and a control unit controlling the driving source at a startup time in a prescribed operational state to rotate the heating rotation unit and the pressure belt in a direction opposite to a recording material conveyance direction of the heating rotation unit and the pressure belt which are rotated to convey a recording material held between the heating rotation unit and the pressure belt.

In this case, the prescribed operational state is, for example, a state after removing the recording material jammed between the heating rotation unit and the pressure belt (after jam treatment of the recording material) or a state after changing the pressure contact force between the heating rotation unit and the pressure belt (after fixing mode change).

According to the fixing device of the present invention, at the startup time in the prescribed operational state, the control unit controls the driving source to rotate the heating rotation unit and the pressure belt in a direction opposite to the recording material conveyance direction. Therefore, contact positions of the sheet member with respect to the plurality of pressurizing members are changed with used of a frictional force between the inner surface of the pressure belt and the sheet member, so that the sheet member is prevented from obstructing independent actions of each of the pressurizing members. As the result, the nip portion formed out of a pressure contact between the heating rotation unit and the pressure belt can maintain proper nip width and proper nip pressure.

Thus, the nip portion has excellent stability, so that fixability and conveyability of the recording material can be improved with a simple construction.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
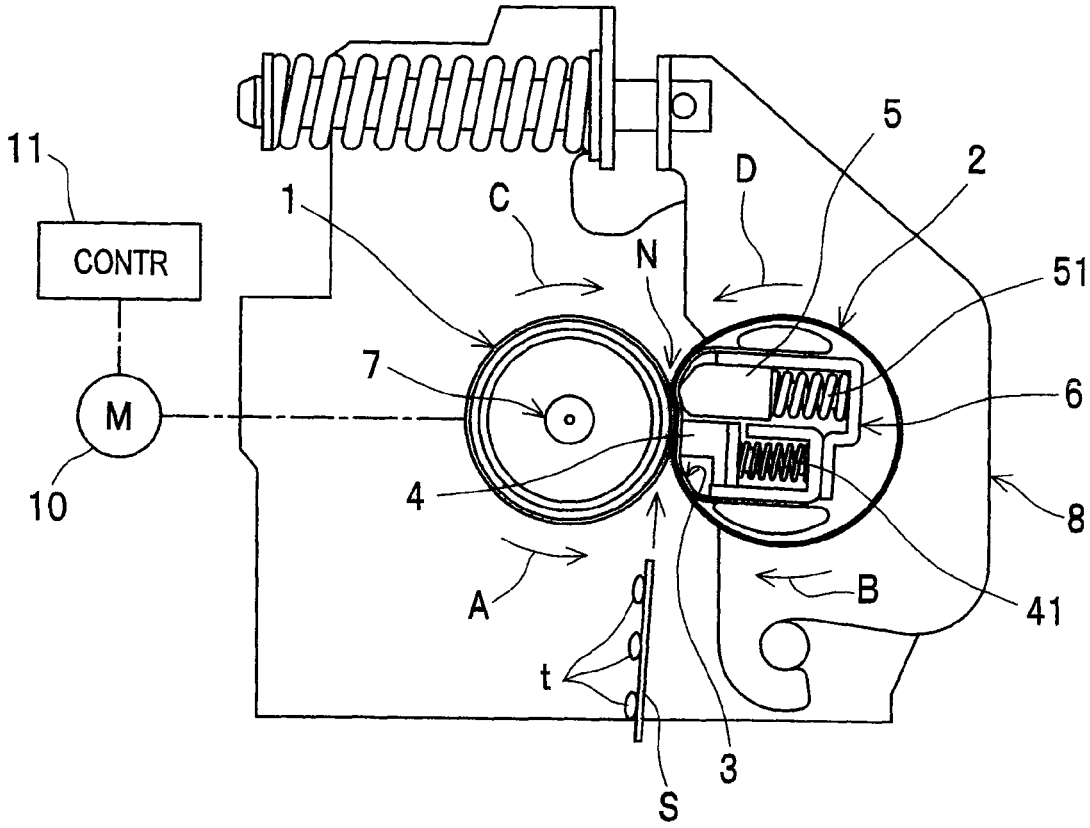
FIG. 1 shows a schematic structural view of a fixing device according to a first embodiment of the present invention.

The present invention will be described in detail below by embodiments shown in the drawings.

First Embodiment

Figure 2:
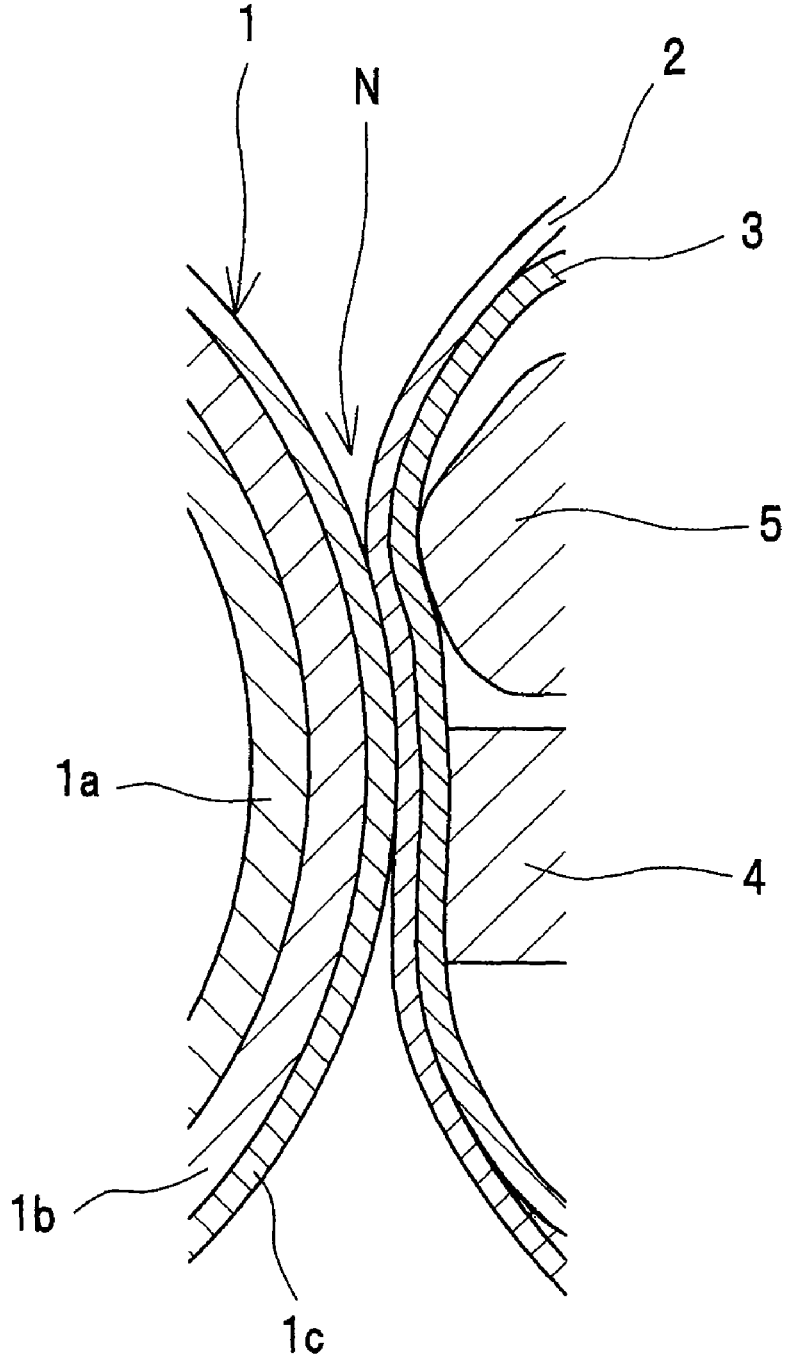
FIG. 2 shows an enlarged sectional view of a nip portion.

FIG. 1 shows a schematic structural view of a fixing device according to a first embodiment of the present invention. FIG. 2 shows an enlarged sectional view of a nip portion. The fixing device is used for an image forming apparatus such as a copying machine, a printer or a facsimile.

The fixing device has a heating roller 1 and an endless pressure belt 2. The heating roller 1 is served as a heating rotation unit. The endless pressure belt 2 is brought in external contact with the heating roller 1 and rotated to follow the rotation of the heating roller 1. A nip portion N is formed between the heating roller 1 and the pressure belt 2.

The heating roller 1 is heated by a halogen lamp 7 placed inside as a heat source, and the heating roller 1 is rotated by a motor 10 as a driving source. The motor 10 is controlled by a control unit 11.

Inside the pressure belt 2, a first pressurizing member 4 and a second pressurizing member 5 are arranged side by side in the rotational direction of the pressure belt 2. The first and second pressurizing members 4 and 5 pressurize the pressure belt 2 against the heating roller 1, so that the nip portion N is formed between the heating roller 1 and the pressure belt 2.

The nip portion N holds and conveys a recording material S while melting and fixing toner t of the recording material S. The recording material S is a sheet such as a paper sheet or an OHP sheet. The toner t is made up of materials having heat fusibility such as a resin, a magnetic material, a colorant and so on.

A sheet member 3 is placed between the pressure belt 2 and the first and second pressurizing members 4 and 5. The sheet member 3 slides on the inner surface of the rotating pressure belt 2 so as to reduce friction between the pressure belt 2 and the first and second pressurizing members 4 and 5. The sheet member 3 is formed by low friction material of, for example, PFA, PTFE or the like.

The heating roller 1 comes in contact with one surface (image surface) of the recording material S. The heating roller 1 is a hollow roller and has a core layer 1*a*, an elastic layer 1*b* and a mold release layer 1*c* in order from the inside to the outside. The heating roller 1 has an outside diameter of 26 mm, for example. The core layer 1*a* is made up of, for example, iron of a thickness of 0.5 mm. The elastic layer 1*b* is made up of, for example, silicone rubber of a thickness of 200 μm. The mold release layer 1*c* is made up of, for example, a PFA tube of a thickness of 20 μm.

Surface temperature of the heating roller 1 is detected by a thermistor (not shown). An output of the halogen lamp 7 is adjusted on the basis of the temperature detected by the thermistor. The halogen lamp 7 of 700-W is adjusted so that the temperature detected by the thermistor becomes 190° C.

The pressure belt 2 is an endless belt. The pressure belt 2 has an outside diameter of, for example, 30 mm and a thickness of 50 μm to 150 μm. The material of the pressure belt 2 is made of, for example, polyimide of a high-temperature resin or a glass fiber base-material impregnated with polyimide.

The first pressurizing member 4 is placed on the upstream side in the direction where the recording material S is conveyed through the nip portion N. The second pressurizing member 5 is placed on the downstream side in the direction where the recording material S is conveyed through the nip portion N.

A retaining member 6 is provided inside the pressure belt 2. The first pressurizing member 4 and the second pressurizing member 5 are fixed via a first support spring 41 and a second support spring 51, respectively, to the retaining member 6. The first support spring 41 and the second support spring 51 are compression springs. The first support spring 41 has a spring constant smaller than that of the second support spring 51.

The first and second pressurizing members 4 and 5 are formed along the axial direction of the pressure belt 2 in such a way to have approximately the same length as width of the heating roller 1 and the pressure belt 2.

The first pressurizing member 4 has hardness smaller than hardness of the second pressurizing member 5. An elastic material having a heat resistance like silicone rubber is used for the first pressurizing member 4. The elastic material improves adhesion to the heating roller 1 and contributes to area enlargement of the nip portion N. Distortion of the elastic material ensures plunge of the recording material S.

A material like a metal or a rigid resin harder than that of the elastic layer 1*b* of the heating roller 1 is used for the second pressurizing member 5, so that the elastic layer 1*b* of the heating roller 1 is distorted to facilitate release of the recording material S.

The retaining member 6 is fixed to a pressurizing lever 8. The pressurizing lever 8 cannot switch a pressure contact force between the heating roller 1 and the pressure belt 2 from one stage to another stage.

The sheet member 3 is fixed on the upstream side and the downstream side in the conveyance direction of the recording material S in such a way that the first and second pressurizing members 4, 5 are interposed. Specifically, the upstream and downstream ends of the sheet member 3 are fixed to the retaining member 6 in such a way that the sheet member 3 covers the first and second pressurizing members 4 and 5.

The control unit 11 controls the motor 10 when conveying the recording material S held between the heating roller 1 and the pressure belt 2, so that the heating roller 1 and the pressure belt 2 are rotated in the direction conveying the recording material, as indicated by the arrows A and B.

On the other hand, the control unit 11 controls the motor 10 when the fixing device is started up in a prescribed operation state, so that the heating roller 1 and the pressure belt 2 are rotated in the opposite direction to the above-stated direction conveying the recording material, as indicated by the arrows C and D.

The prescribed operation state is defined as an operational state in which the pressure contact force between the heating roller 1 and the pressure belt 2 is not switched from one stage to another stage, specifically the operational state after removing the recording material S jammed between the heating roller 1 and the pressure belt 2 (i.e. after jam treatment of the recording material).

Figure 3:
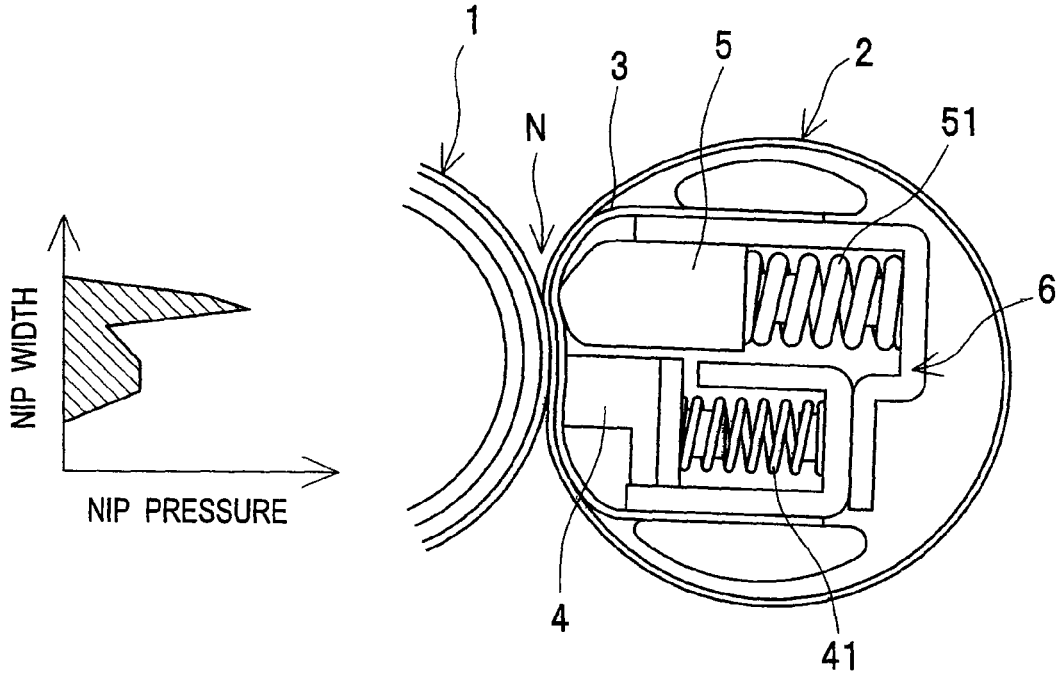
FIG. 3 shows an explanatory view for explaining a proper pressure distribution at the nip portion.

Herein, proper nip width and nip pressure at the nip portion N are described. Hardness of the first pressurizing member 4 is smaller than hardness of the second pressurizing member 5. A spring constant of the first support spring 41 is smaller than that of the second support spring 51. That is to say, as shown in FIG. 3, the pressurizing force of the second pressurizing member 5 is greater than that of the first pressurizing member 4. Part of the nip portion N, which is formed out of the first pressurizing member 4, is set so as to have a broad area at a low pressure in comparison with the other part of the nip portion N, which is formed out of the second pressurizing member 5, as described above. A graph in FIG. 3 shows the nip pressure and width in the horizontal and vertical axes, respectively. The nip width is defined as a length in the conveyance direction of the recording material S at the nip portion N. In this way, the optimal pressure distribution at the nip portion N is set so as to secure the required quality for the fixing device.

When the recording material S is jammed between the heating roller 1 and the pressure belt 2 (when a jam trouble occurs), there occurs a problem that the pressure distribution at the nip portion N disadvantageously deviates from the set point.

Figure 4:
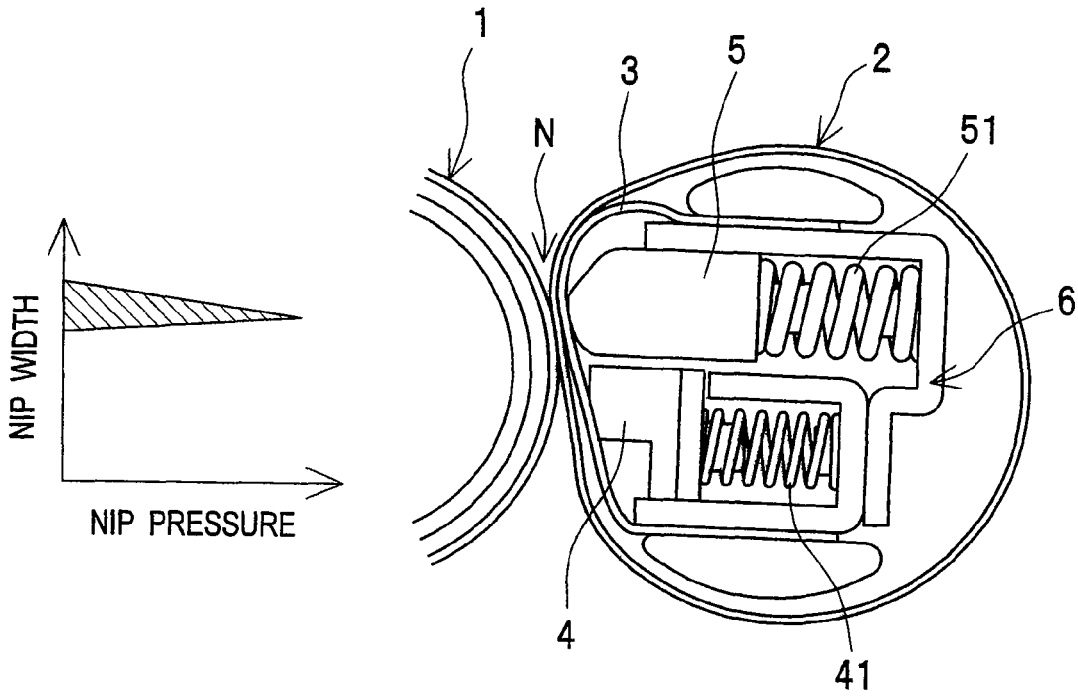
FIG. 4 shows an explanatory view for explaining an improper pressure distribution at the nip portion.

Specifically, the pressure distribution at the nip portion N becomes one shown in FIG. 4 when the user pulls out the recording material S toward the downstream side (upward in the figure) after the recording material S stops in the sate that the recording material S is caught by the nip portion N.

That is to say, when the recording material S is pulled out, the recording material S is moved at a high speed, so that the pressure belt 2 is rotated. Thereby, a strong conveyance force is applied to the sheet member 3 contacting with the inner surface of the pressure belt 2. Consequently, the sheet member 3 enters a tensioned state between the first pressurizing member 4 and the retaining member 6. This may cause a trouble in contact of the first pressurizing member 4 with the heating roller 1.

In this state, the area of the nip portion N is insufficient. This causes a problem of defective fixing of the recording material S. Further, the nip pressure is suddenly increased in the conveyance direction of the recording material S. This causes a problem of erroneous plunge of the recording material S.

Accordingly, by using the control unit 11, the heating roller 1 and the pressure belt 2 are rotated for a prescribed time in the direction opposite to the recording material conveyance direction at the startup time after the jam treatment of the recording material S (i.e., at the fixing operation start time). Thereby, the position of contact between the sheet member 3 and the first and second pressurizing members 4, 5 is changed with use of a frictional force between the pressure belt 2 and the sheet member 3, so that the nip pressure and the nip width at the nip portion N is made proper.

In the case where the pressure of the second pressurizing member 5 is higher than that of the first pressurizing member 4, the contact position of the sheet member 3 is mainly dominated by the second pressurizing member 5. Therefore, it is possible to widely set the duration and velocity of the rotation of the heating roller 1 and the pressure belt 2 in the direction opposite to the recording material conveyance direction, as long as no influence is exerted on the conveyance timing etc. of the recording material S.

Description is next given to control of the motor 10 with use of the control unit 11 at the startup time after the jam treatment of the recording material S.

Figure 5:
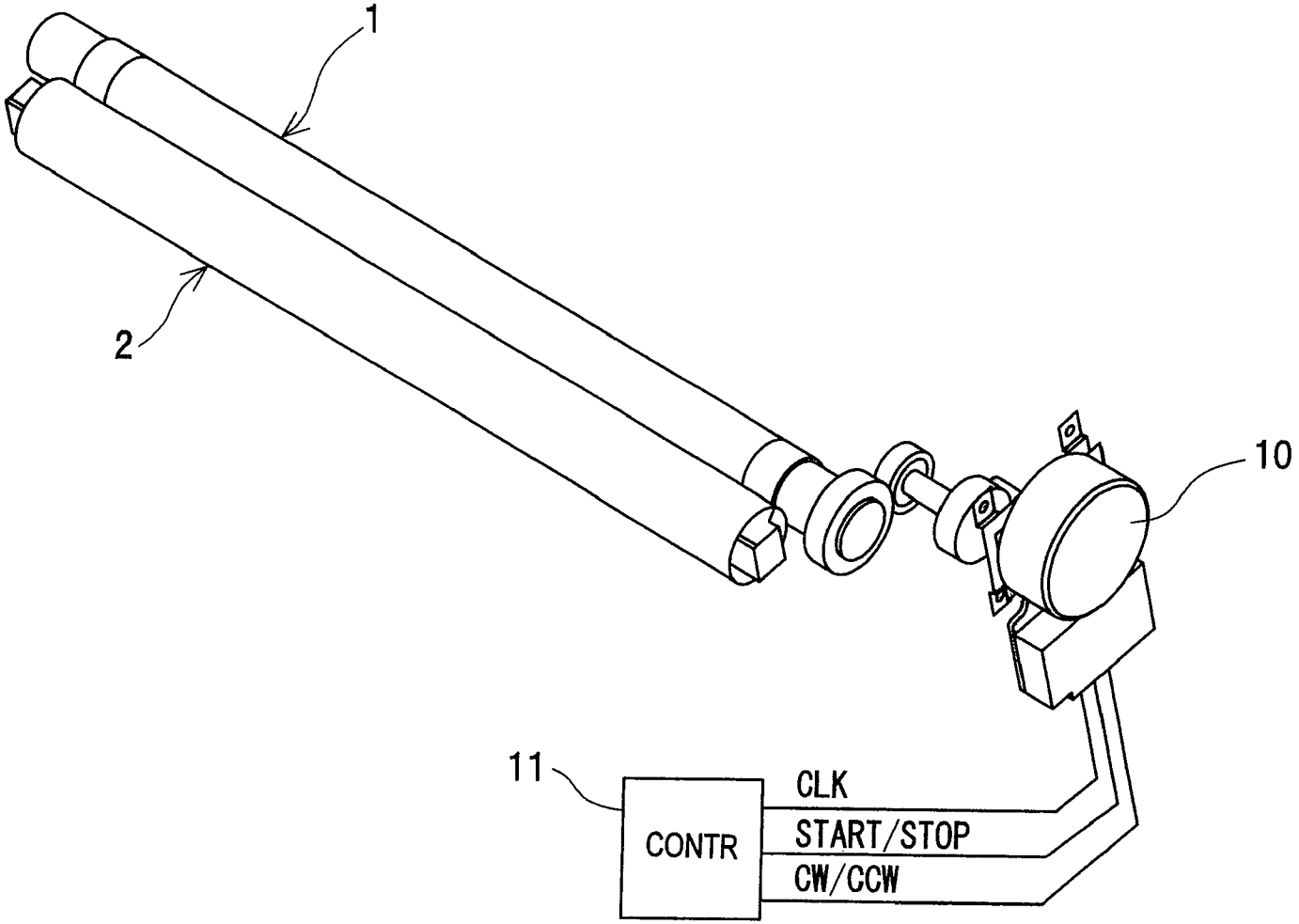
FIG. 5 shows a perspective view of the fixing device for explaining motor control with use of a control unit.
Figure 6:
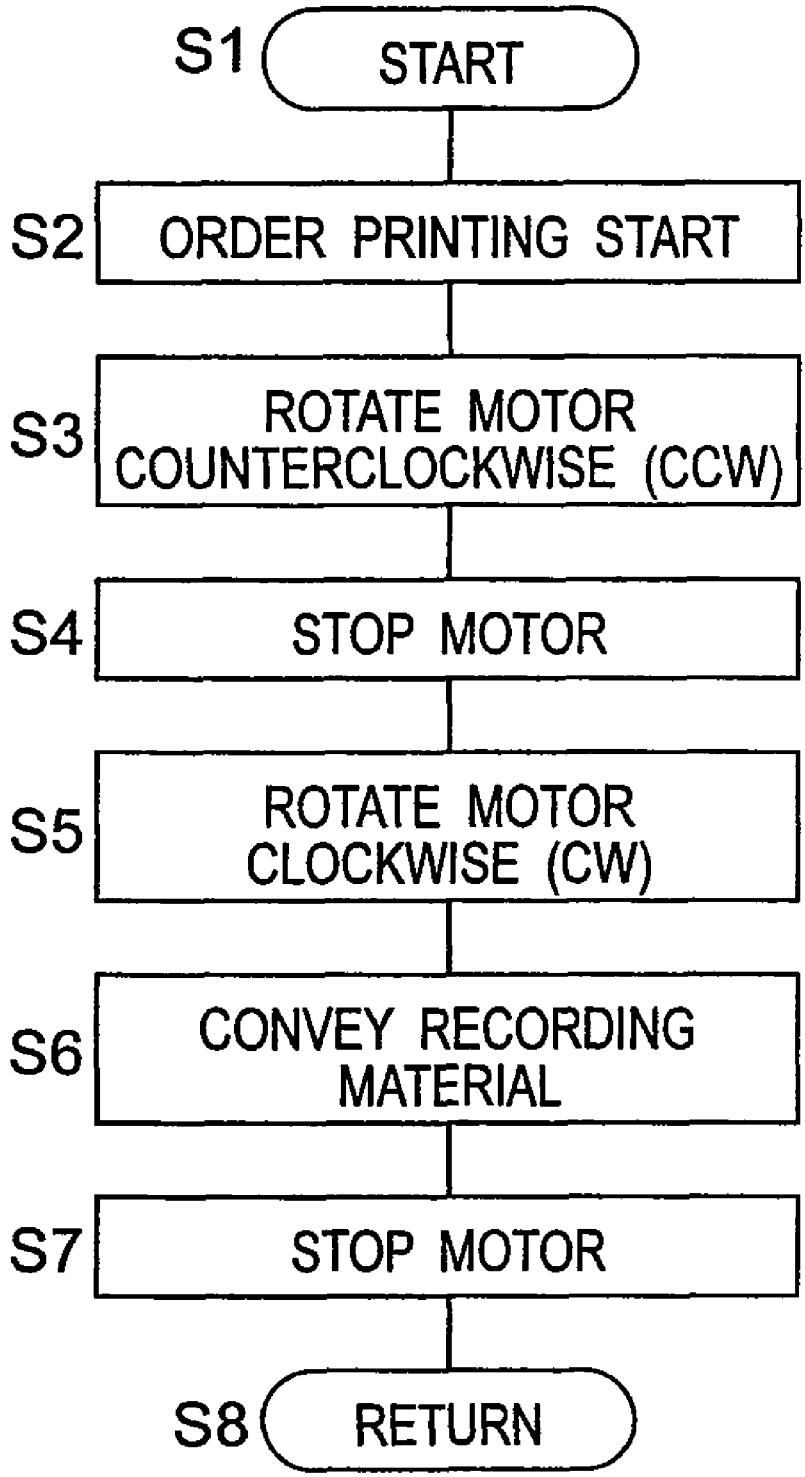
FIG. 6 shows a flow chart for explaining the motor control with use of the control unit.

As shown in a perspective view of FIG. 5 and a flow chart of FIG. 6, the fixing device is started up (step S1), start of printing is ordered (step S2), and the motor 10 is rotated counterclockwise by the control unit 11 (step S3).

When the motor 10 is rotated counterclockwise, the heating roller 1 and the pressure belt 2 are rotated in the direction opposite to the recording material conveyance direction. When the motor 10 is rotated clockwise, the heating roller 1 and the pressure belt 2 are rotated in the recording material conveyance direction.

Then, the motor 10 is stopped (step S4), the motor 10 is rotated clockwise (step S5), the recording material S is conveyed (step S6) and the motor 10 is stopped (step S7). Then, the operational flow is returned again to a standby state until the startup time after the jam treatment of the recording material S (step S8).

According to the fixing device of the above construction, at the startup time in the prescribed operational state, the control unit 11 controls the motor 10 so as to rotate the heating roller 1 and the pressure belt 2 in the direction opposite to the recording material conveyance direction. Thereby, the contact position of the sheet member 3 with respect to the first and second pressurizing members 4 and 5 is changed with use of the frictional force between the inner surface of the pressure belt 2 and the sheet member 3. This prevents the sheet member 3 from obstructing the independent actions of the individual first and second pressurizing members 4 and 5, so that the nip portion N can maintain the proper nip width and nip pressure.

Thus, the nip portion N has excellent stability with a simple construction, this makes it possible to improve the fixability and conveyability of the recording material S.

Hardness of the first pressurizing member 4 located on the upstream side is smaller than hardness of the second pressurizing member 5 located on the downstream side. Therefore, the first pressurizing member 4 having smaller hardness improves adhesion to the heating roller 1, so as to contribute to area enlargement of the nip portion N. Also, the first pressurizing member 4 ensures the plunge of the recording material S with use of its own distortion. On the other hand, the second pressurizing member 5 having greater hardness distorts the heating roller 1 so as to facilitate release of the recording material S. It is noted that hardness of the heating roller 1 is smaller than hardness of the second pressurizing member 5.

The sheet member 3 is fixed on its upstream and downstream sides in the recording material conveyance direction in such a way that the first and second pressurizing members 4 and 5 are interposed between these sides. Thus, even if the heating roller 1 and the pressure belt 2 are rotated either in the recording material conveyance direction or in the direction opposite to the recording material conveyance direction, the sheet member 3 is placed between the pressure belt 2 and the first and second pressurizing members 4 and 5.

Second Embodiment

Figure 7:
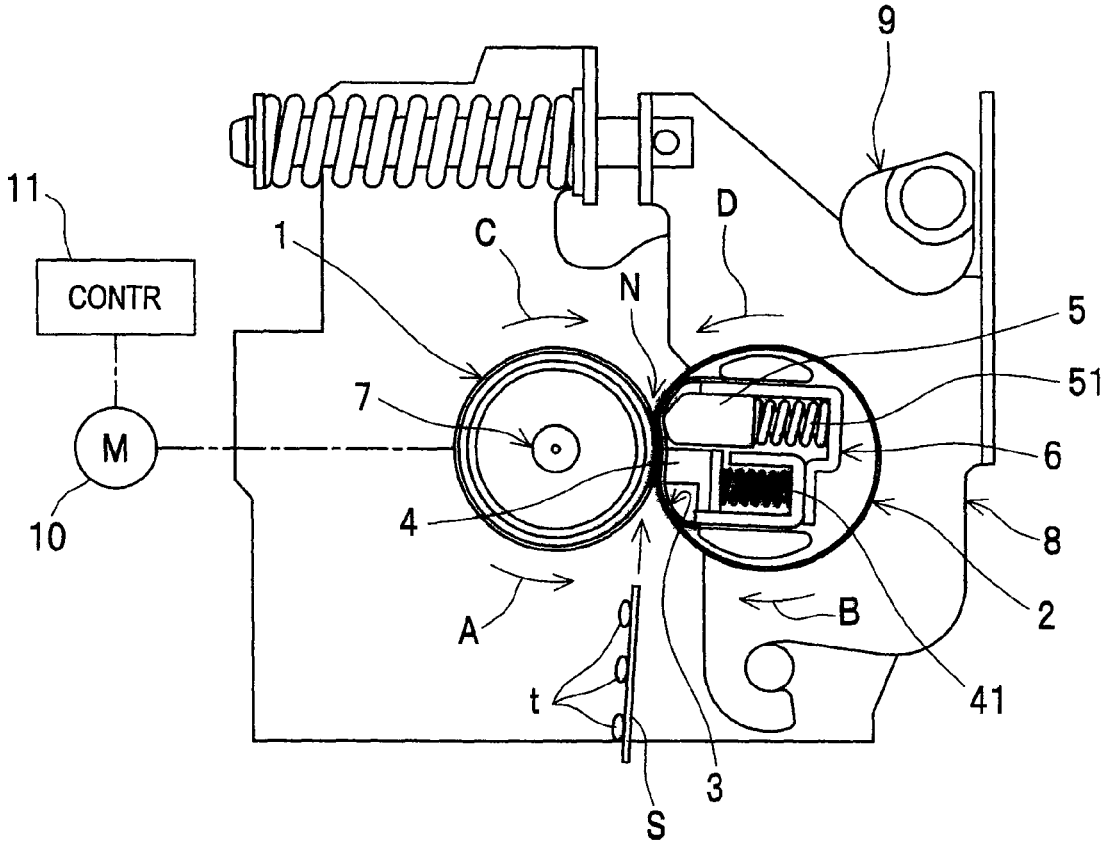
FIG. 7 shows a schematic structural view of the fixing device in a normal fixing mode according to a second embodiment of the present invention.

FIG. 7 shows the fixing device according to a second embodiment of the present invention. The fixing device of the second embodiment is structurally different from the first embodiment (FIG. 1) in a point that the pressure contact force between the heating roller 1 and the pressure belt 2 can be switched from one stage to another stage. Since the other structures than the above are the same as those of the first embodiment, no description is provided therefor.

Figure 8:
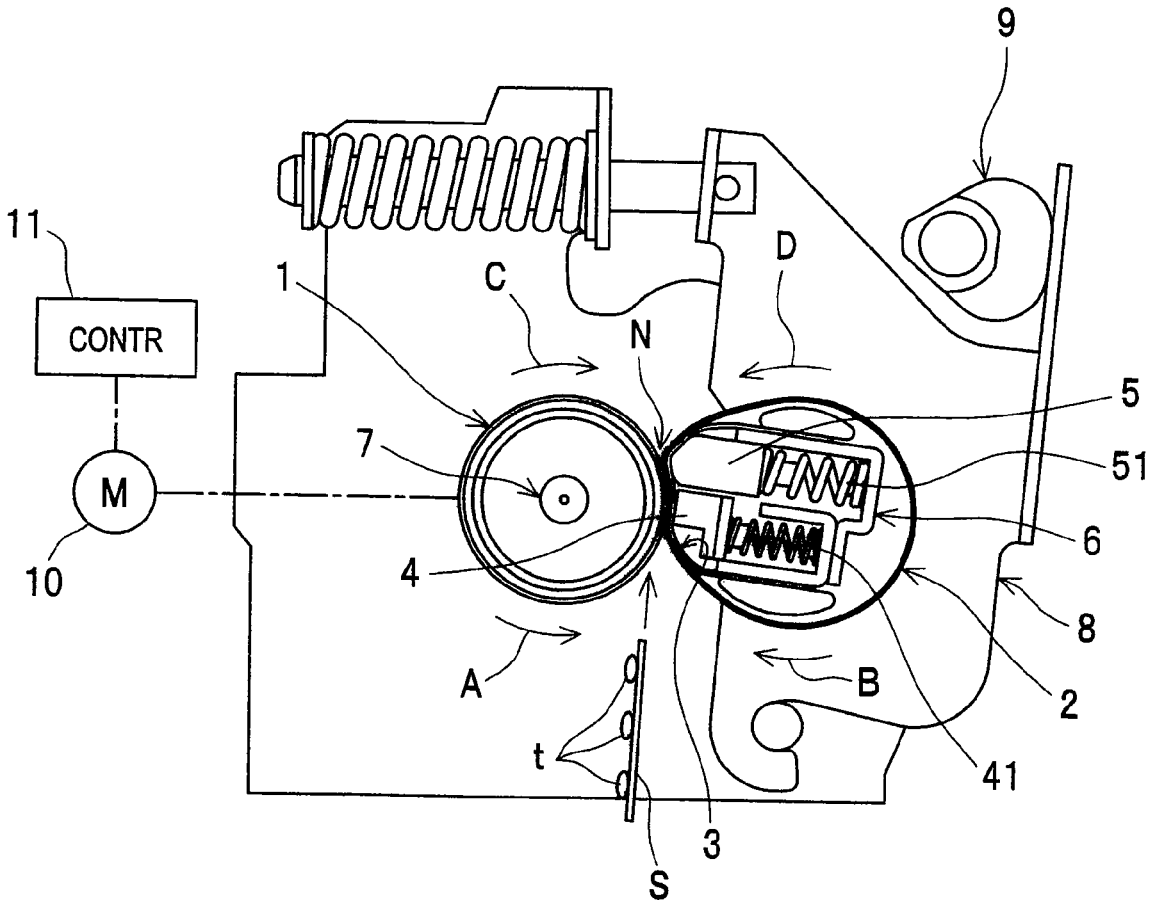
FIG. 8 shows a schematic structural view of the fixing device in an envelope fixing mode according to the second embodiment.

That is, in the present second embodiment, it is possible to switch over between a pressure contact state in a normal fixing mode as shown in FIG. 7 and a pressure contact state in an envelope fixing mode as shown in FIG. 8. In the normal fixing mode, a paper sheet such as a plain-paper or a thick paper, which does not easily wrinkle, is fixed as the recording material S. In the envelope fixing mode, a paper sheet such as an envelope, which easily wrinkles, is fixed as the recording material S. More specifically, the position of the pressure belt 2 is changed via the pressurizing lever 8 by rotating a cam 9 so as to switch over between the normal fixing mode and the envelope fixing mode.

Figure 9:
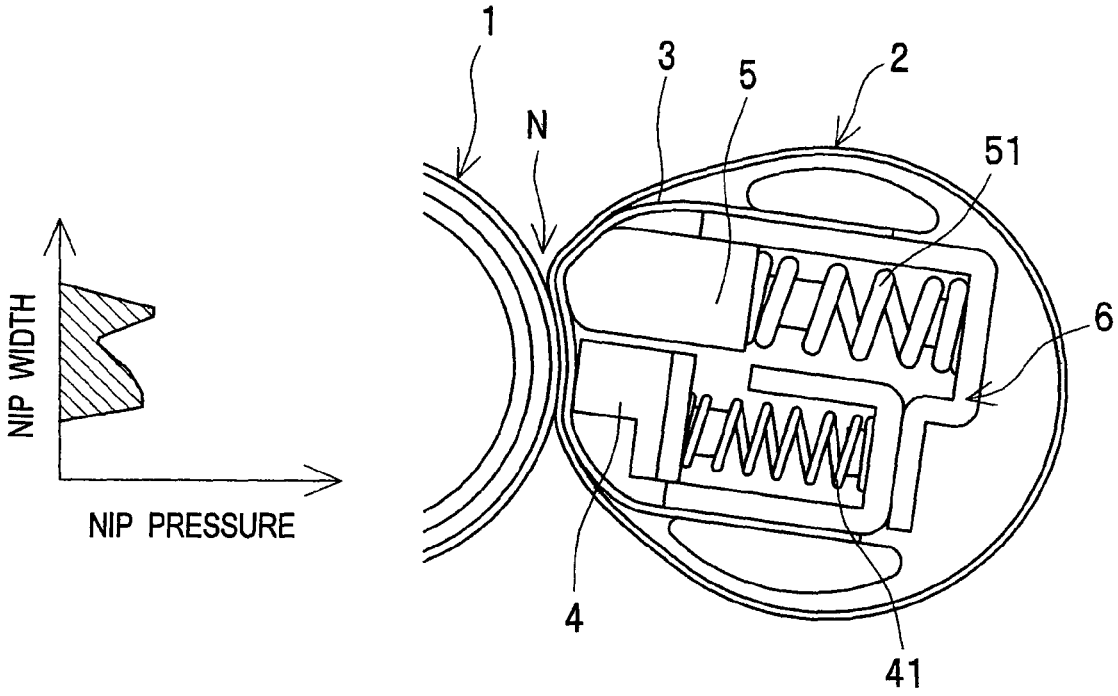
FIG. 9 shows an explanatory view for explaining a proper pressure distribution at the nip portion in the envelope fixing mode.

In the normal fixing mode, the pressure distribution at the nip portion N is in the state shown in FIG. 3. In the envelope fixing mode, on the other hand, the pressure distribution at the nip portion N is in the state shown in FIG. 9. The pressure distribution in the envelope fixing mode is greatly reduced in comparison with the pressure distribution in the normal fixing mode. This makes it possible to prevent occurrence of wrinkles while keeping the plungeability of the paper sheet like an envelope that easily wrinkles.

Then, the contact position of the sheet member 3 with the pressurizing members 4 and 5 is changed at the time of switchover between the normal fixing mode and the envelope fixing mode.

At this time, the second pressurizing member 5 that uses a hard material scarcely poses a problem, whereas the first pressurizing member 4 that uses silicone rubber or the like sometimes disadvantageously adhere to the sheet member 3 due to heat and pressure. As a matter of course, the adhesion is to a degree that it is easily peeled off by applying a small force since it is not a chemical adhesion of surface alteration or the like. However, the adhesion often becomes problematic in the mode switchover by changing the position of the pressurizing lever 8, which causes a problem in quality.

Figure 10:
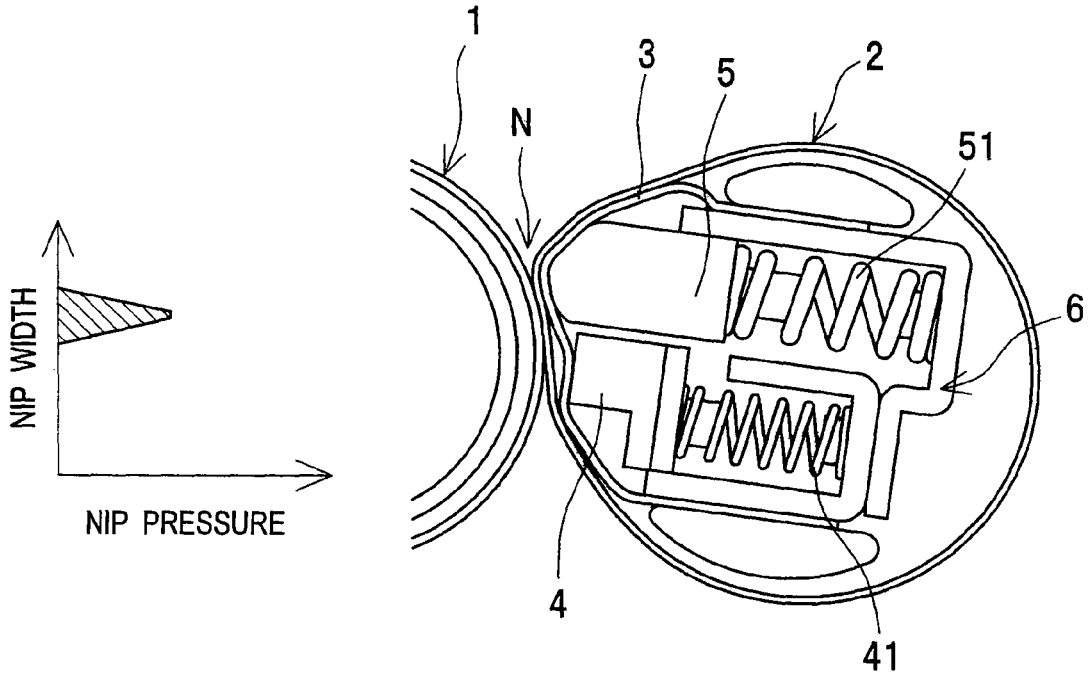
FIG. 10 shows an explanatory view for explaining an improper pressure distribution at the nip portion in the envelope fixing mode.

In the envelope fixing mode, the pressure distribution at the nip portion N is shown in FIG. 10, which causes a problem in quality. As a result of adhesion between the sheet member 3 and the first pressurizing members 4, the first pressurizing member 4 has a malfunction in contact with the heating roller 1. Then, the nip portion N is formed by the contact of only the second pressurizing member 5 with the heating roller 1.

In this state, the area of the nip portion N is insufficient, so that a problem of defective occurs in fixing of an envelope. A sudden increase of the nip pressure in the conveyance direction of the envelope causes a problem of defective plunge of the envelope and also generates wrinkles on the envelope.

Accordingly, after changing the pressure contact force between the heating roller 1 and the pressure belt 2 (after changing the fixing mode), the control unit 11 allows the heating roller 1 and the pressure belt 2 to rotate for a prescribed time in the direction opposite to the recording material conveyance direction. Thereby, the adhesion between the sheet member 3 and the first pressurizing member 4 is removed with use of the frictional force between the pressure belt 2 and the sheet member 3. Also, the contact positions of the sheet member 3 with the first and second pressurizing members 4 and 5 are changed so as to make the nip pressure and the nip width at the nip portion N proper.

That is to say, in an operational state in which the pressure contact force between the heating roller 1 and the pressure belt 2 is changed from one stage to another stage, the control unit 11 controls the motor 10 so as to rotate the heating roller 1 and the pressure belt 2 in the direction opposite to the recording material conveyance direction.

At this time, the control unit 11 rotates the heating roller 1 and the pressure belt 2 in the direction opposite to the recording material conveyance direction for a longer time as the pressure contact force between the heating roller 1 and the pressure belt 2 is weakened.

In short, when the switchover to the envelope fixing mode is recognized, the reverse rotation for the removal of the adhesion is performed consuming a longer time than the duration of the reverse rotation at the startup time of the fixing driving in the normal fixing mode during the shift to the standby state.

It is noted that the control unit 11 controls the motor 10 to rotate the heating roller 1 and the pressure belt 2 in the direction opposite to the recording material conveyance direction, even in an operation state where the pressure contact force between the heating roller 1 and the pressure belt 2 is not changed from one stage to another stage.

That is, the prescribed operational state in which the heating roller 1 and the pressure belt 2 are rotated in the direction opposite to the recording material conveyance direction by the control unit 11 includes a first operational state in which the pressure contact force between the heating roller 1 and the pressure belt 2 is switched from one stage to another stage and a second operational state in which the pressure contact force between the heating roller 1 and the pressure belt 2 is not switched from one stage to another stage.

A description will be given to control of the motor 10 with use of the control unit 11 at the startup time with the normal fixing mode change.

Figure 11:
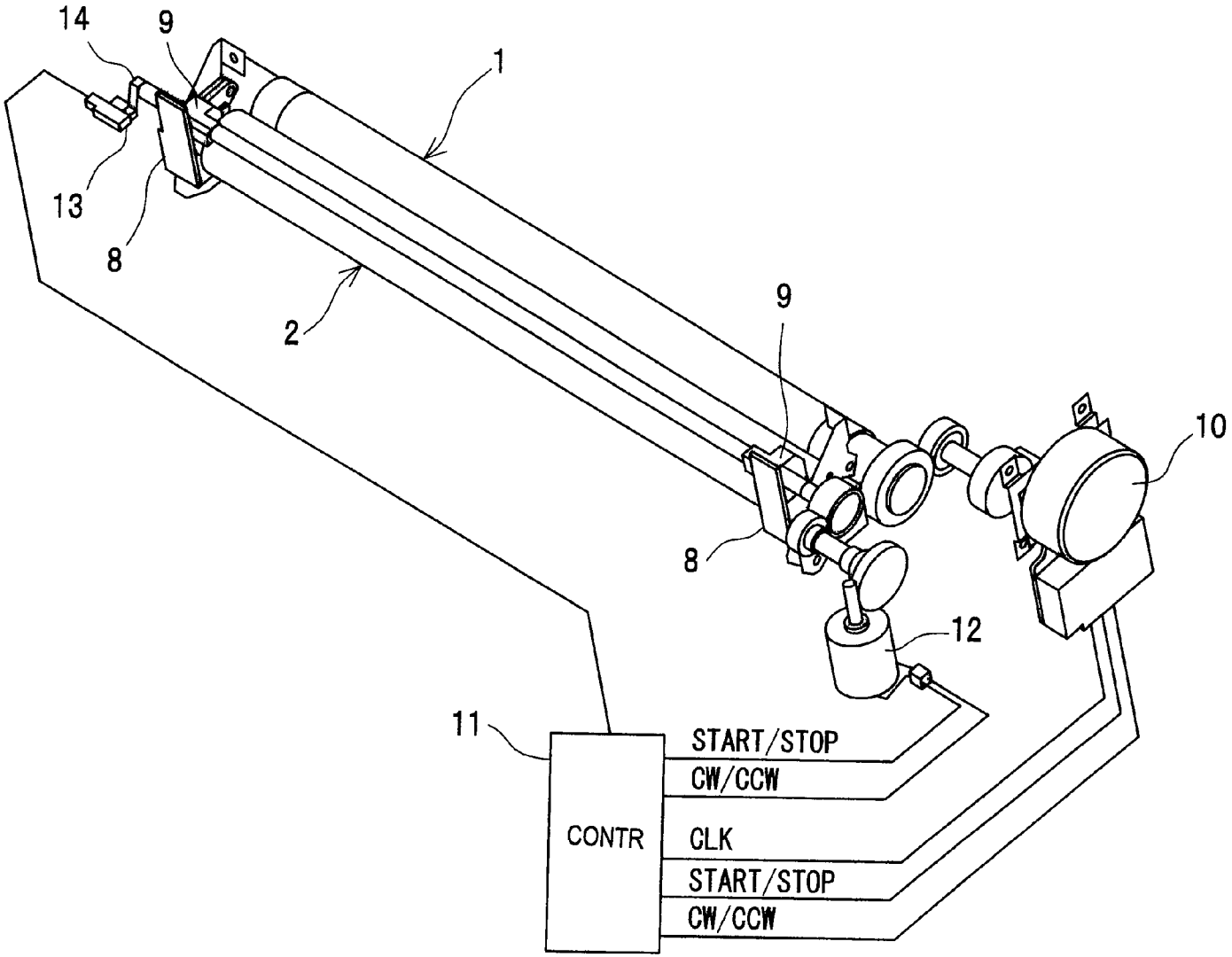
FIG. 11 shows a perspective view of the fixing device for explaining motor control with use of the control unit.
Figure 12:
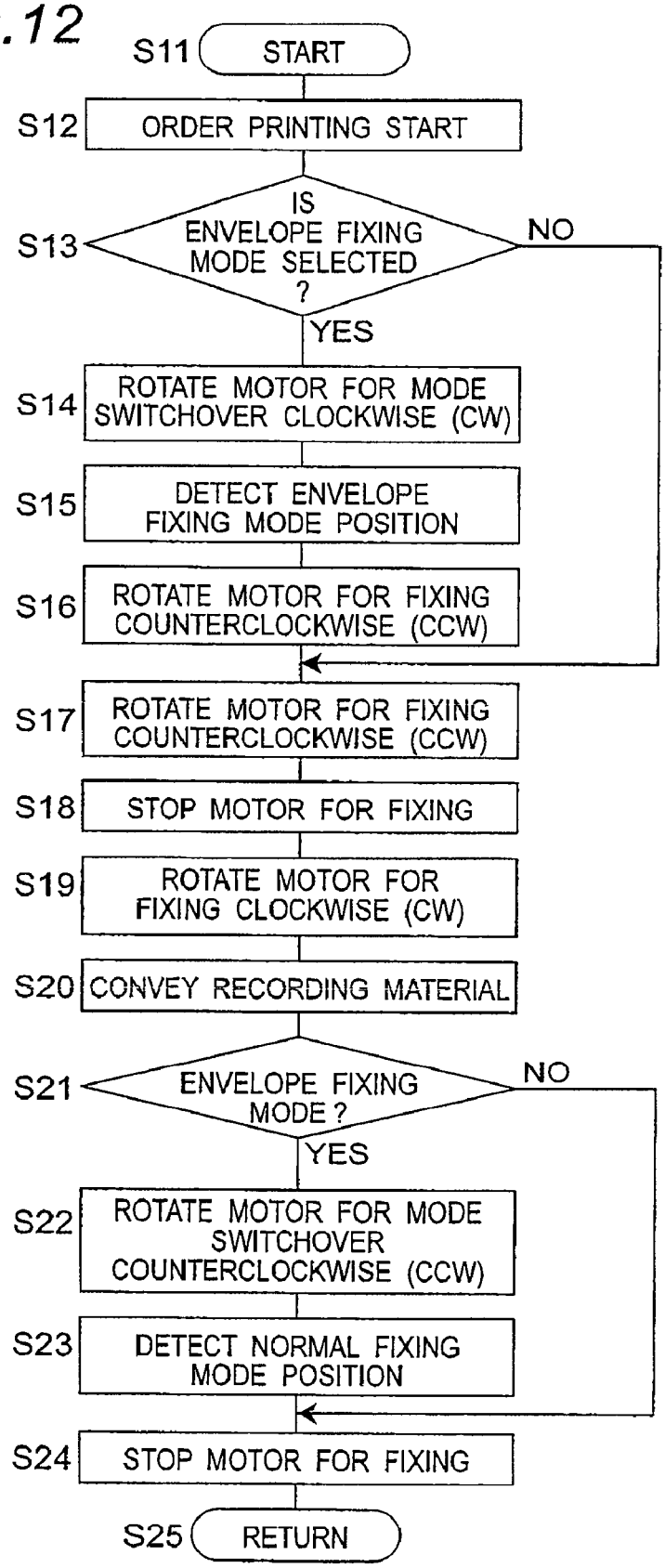
FIG. 12 shows a flow chart for explaining the motor control with use of the control unit.

As shown in the perspective view of FIG. 11 and the flow chart of FIG. 12, the fixing device is started up (step S11), start of printing is ordered (step S12), and the envelope fixing mode is selected (step S13).

When the envelope fixing mode is selected, a motor 12 for mode switchover is rotated clockwise by using the control unit 11 (step S14), and it is detected that the pressure belt 2 is located in the position of the envelope fixing mode by the control unit 11 (step S15).

In this case, when the motor 12 for mode switchover is rotated clockwise, the cam 9 linked to the motor 12 is rotated to move the pressure belt 2 from the position of the normal fixing mode to the position of the envelope fixing mode via the pressurizing lever 8. When the motor 12 for mode switchover is rotated counterclockwise, the cam 9 linked to the motor 12 is rotated to move the pressure belt 2 from the position of the envelope fixing mode to the position of the normal fixing mode via the pressurizing lever 8.

A light shield plate 14 is attached to the pressurizing lever 8. The light shield plate 14 is detected by a lever position detection switch 13. Thereby, it is determined whether the pressure belt 2 is located in the position of the normal fixing mode or in the position of the envelope fixing mode.

Then, the motor 10 for fixing is rotated counterclockwise twice by the control unit 11 (step S16 and step S17). If the envelope fixing mode is not selected, the motor 10 for fixing is rotated counterclockwise only once by the control unit 11 (step S17). In this case, when the motor 10 is rotated counterclockwise, the heating roller 1 and the pressure belt 2 are rotated in the direction opposite to the recording material conveyance direction. When the motor 10 is rotated clockwise, the heating roller 1 and the pressure belt 2 are rotated in the recording material conveyance direction.

Then, the motor 10 for fixing is stopped (step S18), the motor 10 for fixing is rotated clockwise (step S19), the recording material S is conveyed (step S20), and then it is determined whether or not the current mode is the envelope fixing mode (step S21).

If it is determined that the current mode is the envelope fixing mode, then the motor 12 for mode switchover is rotated counterclockwise by the control unit 11 (step S22). It is detected that the pressure belt 2 is located in the position of the normal fixing mode by the control unit 11 (step S23), and thereafter the motor 10 for fixing is stopped (step S24). If it is determined that the current mode is not the envelope fixing mode, then the motor 10 for fixing is stopped (step S24).

Then, the operational flow is returned to a standby state again until the startup time of fixing mode change (step S25).

According to the fixing device of the above construction, the prescribed operational state includes the first operational state in which the pressure contact force between the heating roller 1 and the pressure belt 2 is switched from one stage to another stage and the second operational state in which the pressure contact force between the heating roller 1 and the pressure belt 2 is not switched from one stage to another stage in addition to the operational effect of the first embodiment. Therefore, the stability of the nip portion N can be improved regardless of whether or not the pressure contact force between the heating roller 1 and the pressure belt 2 has been changed from one stage to another stage.

The control unit 11 controls the motor 10 to rotate the heating roller 1 and the pressure belt 2 for a longer time in the direction opposite to the recording material conveyance direction as the pressure contact force between the heating roller 1 and the pressure belt 2 is weakened in the first operational state. Therefore, although the influence of the adhesion between the first pressurizing member 4 and the sheet member 3 exerted on the stability of the nip portion N is increased as the pressure contact force between the heating roller 1 and the pressure belt 2 is weakened, the adhesion between the first pressurizing member 4 and the sheet member 3 is reliably prevented to allow the stability of the nip portion N to be maintained more reliably.

The present invention is limited to neither one of the above embodiments. For example, the heating rotation unit may be a belt besides the heating roller 1. Moreover, the halogen lamp 7 may be placed outside the heating roller 1. Electromagnetic induction heating may be used as a heat source for heating the heating roller 1.

The prescribed operational state in which the heating roller 1 and the pressure belt 2 are rotated in the direction opposite to the recording material conveyance direction by the control unit 11 may include only the first operational state that is the operational state in which the pressure contact force between the heating roller 1 and the pressure belt 2 is switched from one stage to another stage. When the pressure contact force between the heating roller 1 and the pressure belt 2 is switched from one stage to another stage, the stability of the nip portion N can be improved.

The duration, in which the heating roller 1 and the pressure belt 2 are rotated in the direction opposite to the recording material conveyance direction by the control unit 11, is determined by temperature of the fixing device, materials and surface roughness of the pressurizing members 4 and 5, material and surface roughness of the sheet member 3 and so on.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A fixing device comprising:

a heating rotation unit configured to be heated by a heat source and rotated by a driving source;

an endless pressure belt brought in external contact with the heating rotation unit and configured to be rotated to follow rotation of the heating rotation unit;

a plurality of pressurizing members arranged side by side inside the pressure belt in a rotation direction of the pressure belt and pressurizing the pressure belt against the heating rotation unit;

a sheet member placed between the pressure belt and the plurality of pressurizing members and configured to slide on an inner surface of the rotating pressure belt; and a control unit to control the driving source to rotate, at a startup time of the fixing device before conveying a recording material, the heating rotation unit and the pressure belt in a direction opposite to a recording material conveyance direction in which the heating rotation unit and the pressure belt rotate to convey the recording material, wherein the rotation of the heating rotation unit and the pressure belt in the direction opposite to the recording material conveyance direction is for an amount sufficient to cause a change in a position of contact between the sheet member and the plurality of pressurizing members.

2. The fixing device as set forth in claim 1, further comprising:

a switching unit to switch a pressure contact force between the heating rotation unit and the pressure belt, wherein the control unit controls the driving source to rotate the heating rotation unit and the pressure belt in the direction opposite to the recording material conveyance direction at the startup time in a first operational state in which the pressure contact force between the heating rotation unit and the pressure belt has been switched from a first stage to a second stage.

3. The fixing device as set forth in claim 2, wherein the control unit controls the driving source to rotate the heating rotation unit and the pressure belt in the direction opposite to the recording material conveyance direction as a first pressure contact force between the heating rotation unit and the pressure belt in the second stage is weakened to a second pressure contact force between the heating rotation unit and the pressure belt in the first stage.

4. The fixing device as set forth in claim 1, wherein the plurality of pressurizing members include:

a first pressurizing member located on an upstream side in the recording material conveyance direction; and a second pressurizing member located on a downstream side in the recording material conveyance direction, wherein the first pressurizing member has a hardness smaller than a hardness of the second pressurizing member.

5. The fixing device as set forth in claim 4, wherein the heating rotation unit has a hardness smaller than the hardness of the second pressurizing member.

6. The fixing device as set forth in claim 4, wherein the second pressurizing member has a pressurizing force greater than a pressurizing force of the first pressurizing member.

7. The fixing device as set forth in claim 1, wherein the sheet member is fixed on an upstream side and a downstream side in the recording material conveyance direction in such a way that the plurality of pressurizing members are interposed.

8. The fixing device as set forth in claim 1, wherein the control unit controls the driving source to rotate the heating rotation unit and the pressure belt in the direction opposite the recording material conveyance direction at the startup time in an operational state following removal of a jammed recording material from between the heating rotation unit and the pressure belt.

* * * * *